US006519437B1

(12) United States Patent
Aoki et al.

(10) Patent No.: US 6,519,437 B1
(45) Date of Patent: Feb. 11, 2003

(54) PREVENTION OF EXCESSIVE TONER ACCUMULATION IN A DEVELOPING APPARATUS

(75) Inventors: Shinji Aoki, Tokyo (JP); Takao Izumi, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/934,657

(22) Filed: Aug. 23, 2001

(51) Int. Cl.[7] ..... G03G 15/08
(52) U.S. Cl. ..... 399/281; 399/284
(58) Field of Search ..... 399/281, 284

(56) References Cited

U.S. PATENT DOCUMENTS 5,132,734 A * 7/1992 Momiyama et al. ..... 399/281
5,594,198 A * 1/1997 Ikeda et al. ..... 399/281
6,049,689 A 4/2000 Ishii et al. ..... 399/284
6,144,829 A * 11/2000 Miyasaka et al. ..... 399/281

FOREIGN PATENT DOCUMENTS

JP 9-230695 9/1997
JP 11-52721 2/1999

* cited by examiner

*Primary Examiner*—William J. Royer
(74) *Attorney, Agent, or Firm*—Foley & Lardner

(57) ABSTRACT

A developing apparatus with a developing roller is brought in contact with an image bearer, and rotates upwards from below in a contact portion to supply a developer to the image bearer, a supply roller which is brought in contact with the developing roller, and rotates in the same direction as the direction of the developing roller to supply toner to the developing roller, a carrying blade for carrying the toner to the supply roller, a retaining member which is positioned below the supply roller and disposed apart from the developing roller, and which retains the developer carried by the carrying blade and allows the retained developer to be supplied to the developing roller by the supply roller, and a layer thickness regulating blade for regulating a layer thickness of the developer supplied onto the developing roller.

9 Claims, 3 Drawing Sheets

PREVENTION OF EXCESSIVE TONER ACCUMULATION IN A DEVELOPING APPARATUS

BACKGROUND OF THE INVENTION

The present invention relates to a developing apparatus mounted, for example, on a copying machine to which electrophotography is applied, to a printer, and the like.

An electrophotographic copying machine includes, for example, a four-color developing apparatus. A color toner image is formed on a photosensitive belt by the four-color developing apparatus, and transferred to a sheet via an intermediate transfer drum.

This type of electrophotographic copying machine is preferably designed so that a moving direction of the sheet in a contact portion of the photosensitive belt and a developing roller is extended upwards from below in order to advantageously convey the sheet.

Moreover, there is provided a developing apparatus including a supply roller for supplying toner in contact with the developing roller, and a toner supply chamber disposed below the supply roller. The toner supply chamber is constituted of a guide plate disposed below the supply roller, and a sheet member disposed between the guide plate and the developing roller.

However, the conventional developing apparatus has the following problem.

That is, a toner is accumulated in a space formed by four members, that is, the guide plate and sheet member forming the toner supply chamber, the developing roller and the supply roller. Furthermore, a new toner is pushed into the space with the toner accumulated therein by rotation of the supply roller, and therefore, the toner is excessively accumulated. This causes a problem that a driving torque of the supply and developing rollers increases.

Moreover, the uncharged toner accumulated on the sheet member is directly supplied onto the developing roller. The uncharged toner has a small adhesion to the developing roller. As a result, a layer formation defect is generated in a nip portion between a layer thickness regulating blade and the developing roller. There is a problem that toner spilling easily occurs particularly in a region with a peripheral speed of the developing roller exceeding 250 mm/s.

BRIEF SUMMARY OF THE INVENTION

The present invention has been developed in consideration of the aforementioned situation, and an object thereof is to provide a developing apparatus in which a developer can be supplied between a supply roller and a developing roller without being excessively accumulated, and an uncharged developer is prevented from being directly fed between a developing roller and a layer thickness regulating member.

According to the present invention, there is provided a developing apparatus comprising: a developing roller which is brought in contact with an image bearer, and rotates upwards from below in a contact portion to supply a developer to the image bearer; a supply roller which is brought in contact with the developing roller, and rotates in the same direction as that of the developing roller to supply the developer to the developing roller; a carrying device for carrying the developer to the supply roller; a retaining member which is positioned below the supply roller and disposed apart from the developing roller, and which retains the developer carried by the carrying device and allows the retained developer to be supplied to the developing roller by the supply roller; and a layer thickness regulating member for regulating a layer thickness of the developer supplied onto the developing roller.

According to the present invention, there is further provided a developing apparatus comprising: a developing roller which is brought in contact with an image bearer, and rotates upwards from below in a contact portion to supply a developer to the image bearer; a supply roller which is brought in contact with the developing roller, and rotates in the same direction as that of the developing roller to supply the developer to the developing roller; a carrying device for carrying the developer to the supply roller; a guide member which is positioned below the supply roller and disposed apart from the developing roller, and which guides the developer carried by the carrying device to the supply roller; an auxiliary guide which is disposed between the guide member and the developing roller, and which guides the developer fed from the guide member by rotation of the supply roller to the developing roller; and a layer thickness regulating member for regulating a layer thickness of the developer supplied onto the developing roller. The auxiliary guide has a structure for dropping a part of the developer downwards during guiding of the developer, and a tip end of the auxiliary guide in a guide direction of the developer is allowed to abut on the developing roller. The abutment portion is constituted of a macromolecular material, the developer on the developing roller is preliminarily charged, and a layer thickness of the developer is regulated.

According to the present invention, there is also provided a developing apparatus comprising: a developing roller which is brought in contact with an image bearer, and rotates upwards from below in a contact portion to supply a developer to the image bearer; a supply roller which is brought in contact with the developing roller, and rotates in the same direction as that of the developing roller to supply the developer to the developing roller; a carrying device for carrying the developer to the supply roller; a guide member which is positioned below the supply roller and disposed apart from the developing roller, and which guides the developer carried by the carrying device to the supply roller; an auxiliary guide which is disposed between the guide member and the developing roller, and which receives the developer falling from the contact portion between the developing roller and the supply roller and guides the developer to the developing roller; a movement regulating member for regulating movement of the developer to the auxiliary guide from the guide member; and a layer thickness regulating member for regulating a layer thickness of the developer supplied onto the developing roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
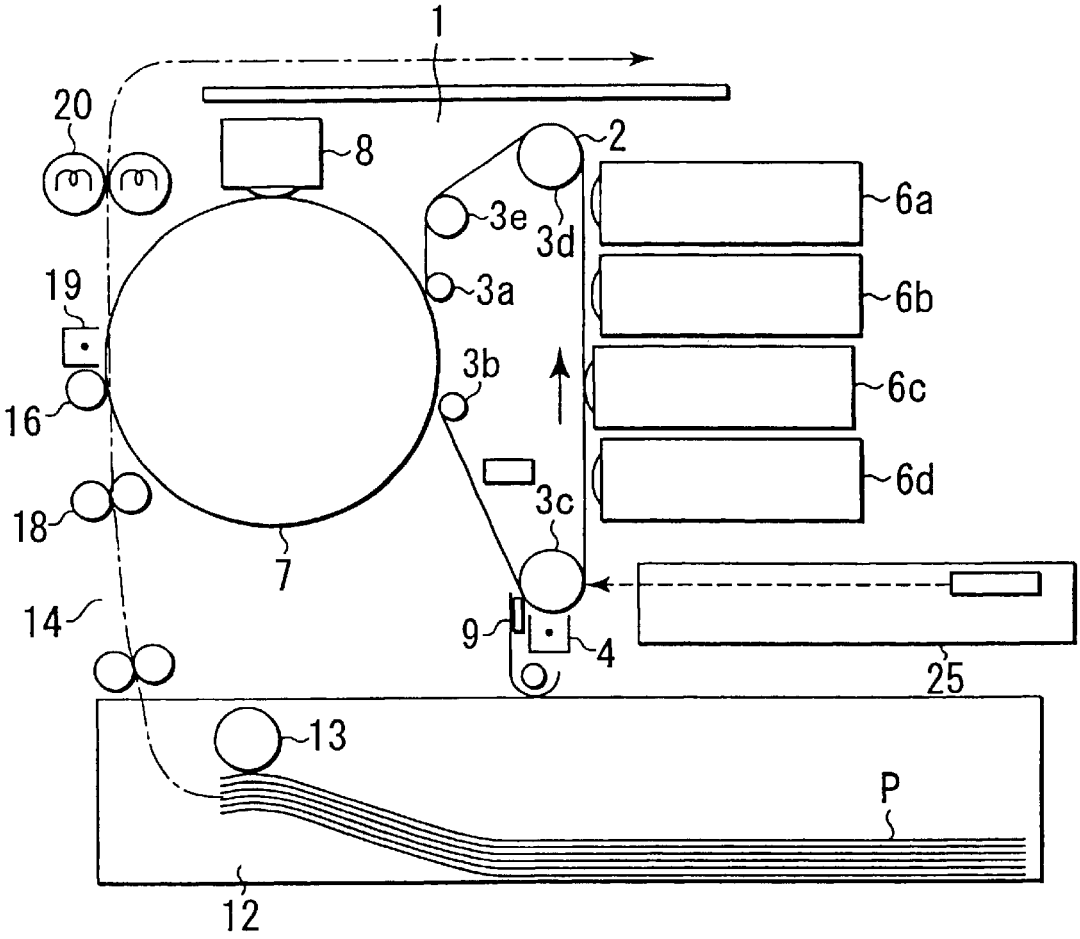
FIG. 1 is a constitution diagram showing a color electrophotographic copying apparatus according to one embodiment of the present invention.

The present invention will be described hereinafter in detail with reference to embodiments shown in the drawings.

FIG. 1 is a constitution diagram showing a color electrophotographic apparatus as an image forming apparatus according to one embodiment of the present invention.

The color electrophotographic apparatus includes an image forming section 1. The image forming section 1 has a photosensitive belt 2 as an image bearer. The photosensitive belt 2 is extended-along a plurality of first to fifth rollers 3*a* to 3*e* with a predetermined tension, and runs along an arrow direction.

A charging apparatus 4 for charging the photosensitive belt 2 at a predetermined potential, an exposure apparatus 25 for forming an electrostatic latent image on the charged photosensitive belt 2, and first to fourth developing apparatuses 6*a* to 6*d* for supplying a toner to the electrostatic latent image formed on the photosensitive belt 2 and visualizing the image are disposed in a periphery of the photosensitive belt 2 along a running direction of the belt. Furthermore, a rotatable intermediate transfer member 7 for once holding a toner image formed on the photosensitive belt 2, and a cleaner apparatus 9 for removing the toner remaining on the photosensitive belt 2 are disposed in the periphery of the photosensitive belt 2 along the running direction of the belt. Additionally, a cleaner 8 for cleaning the intermediate transfer member 7 is disposed above the intermediate transfer member 7.

A portion of the photosensitive belt 2 extended between the first and second rollers 3*a* and 3*b* is attached to an outer peripheral surface of the intermediate transfer member 7, and portions extended along the third and fourth rollers 3*c* and 3*d* are disposed apart from and opposite to the developing apparatuses 6*a* to 6*d* via a constant gap.

Additionally, a driving motor (not shown) is connected to any one of the first to fifth rollers 3*a* to 3*e*, and the first to fifth rollers 3*a* to 3*e* are rotated/driven in the arrow direction at a predetermined speed by rotation of the driving motor.

On the other hand, a sheet cassette 12 for containing sheet P as a predetermined-size transfer material is disposed under the image forming section 1. A sheet supply roller 13 for taking out the sheets P one by one is disposed in the sheet cassette 12.

A conveying system 14 for conveying the sheet P to the intermediate transfer member 7 is disposed between the sheet cassette 12 and the intermediate transfer member 7. A transfer roller 16 is disposed opposite to the intermediate transfer member 7 in the conveying system 14, and the toner image formed on the intermediate transfer member 7 is transferred to the sheet P.

Additionally, an aligning roller 18 is disposed on an upstream side of a sheet conveying direction of the transfer roller 16. At the aligning roller 18, the sheet P conveyed by the conveying system 14 is once stopped, inclination of the sheet P with respect to the conveying direction is corrected, and a tip end of the sheet P is aligned with the tip end of the toner image on the intermediate transfer member 7.

A stripping apparatus 19 for supplying an AC charge to strip the sheet P with the toner image transferred thereto from the intermediate transfer member 7, and a fixing apparatus 20 for fixing the toner image transferred to the sheet P onto the sheet P are disposed on a downstream side of the sheet conveying direction of the transfer roller 16.

A full-color printing operation by the aforementioned color electrophotographic apparatus will next be described.

First, the surface of the rotating photosensitive belt 2 is uniformly charged at a predetermined potential by the charging apparatus 4. Subsequently, the photosensitive belt 2 is subjected to exposure for a yellow image by the exposure apparatus 5, and an electrostatic latent image is formed. The electrostatic latent image on the photosensitive belt 2 is developed by a yellow toner supplied from the yellow developing apparatus 6*a*, and further transferred onto the intermediate transfer member 7. After the transfer, the photosensitive belt 2 is stripped from the intermediate transfer member 7, and static electricity is removed by a static eliminator (not shown). Moreover, toner remaining on the photosensitive belt 2 without being transferred to the intermediate transfer member 7 is cleaned by the cleaner by the apparatus 9. The cleaned toner is collected in a waste toner box (not shown).

Thereafter, the photosensitive belt 2 is recharged by the charging apparatus 4, exposure for a magenta image is performed by the exposure apparatus 25, and the electrostatic latent image is formed. The electrostatic latent image on the photosensitive belt 2 is developed with a magenta toner by the magenta developing apparatus 6*b*, and a magenta toner image is superposed and transferred onto the yellow toner image on the intermediate transfer member 7. Similar steps are also performed with respect to cyan and black toner images, and a four-color superposed toner image is formed on the intermediate transfer member 7.

After the image is formed, the sheet P is supplied between the intermediate transfer member 7 and the transfer roller 16, and the four-color superposed toner image is collectively and secondarily transferred to the sheet P. The sheet holding the four-color toner image is stripped from the intermediate transfer member 7 by the stripping apparatus 19, and reaches the fixing apparatus 20, so that a color image with the toner fixed thereto is obtained.

On the other hand, the toner which cannot completely be transferred to the sheets P remains on the intermediate transfer member 7. Therefore, after completion of the secondary transfer, the cleaner 8 is brought in contact with the intermediate transfer member 7 to clean the intermediate transfer member.

Additionally, while the aforementioned four-color superposed toner image is formed on the intermediate transfer member 7, the cleaner 8 is disposed apart from the intermediate transfer member 7.

Figure 2:
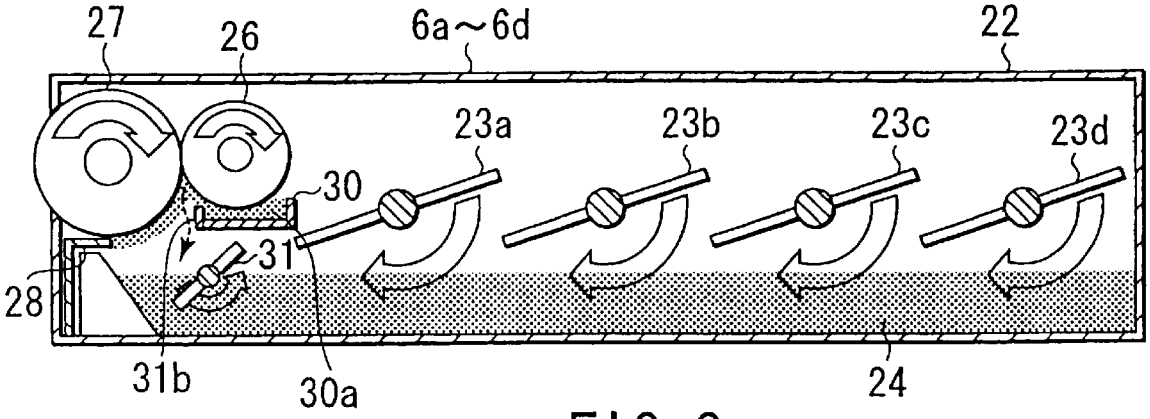
FIG. 2 is an inner constitution diagram showing a first embodiment of a developing apparatus.

FIG. 2 is a constitution diagram showing the aforementioned non-magnetic mono-component developing apparatuses 6*a* to 6*d*.

The developing apparatuses 6*a* to 6*d* include a developer container 22 for containing a nonmagnetic mono-component toner 24 as a developer. A plurality of (four) carrying blades 23*a* to 23*d* for carrying the toner are disposed in the developer container 22. A supply roller 26 and developing roller 27 are disposed in front of the carrying blade 23*a*. A layer thickness regulating blade 28 as a layer thickness regulating device for regulating a toner layer on the developing roller 27 at a constant layer thickness is disposed under the developing roller 27.

During a developing operation, the carrying blades 23*a* to 23*d* are rotated, and the toner is carried and once retained by a retaining member by rotation of the blades as described later, and subsequently fed to the supply roller 26. The toner is supplied to the developing roller 27 by the rotation of the supply roller 26. Moreover, the toner supplied by the developing roller 27 is regulated by the layer thickness regulating blade 28 so that the layer thickness becomes constant. After the layer thickness of the toner layer on the developing roller 27 is set to be constant, the toner is supplied to the electrostatic latent image on the photosensitive belt 2 and the image is visualized.

Additionally, a retaining member 30 for temporarily retaining the toner 24 is disposed under the supply roller 26, and a carrying blade 31 for agitating/carrying the toner 24 in the arrow direction is disposed under the retaining member 30.

The retaining member 30 is disposed apart from a bottom surface of the developer container 22 and the developing roller 27. The carrying blade 23*a* is disposed in a position in which the blade can contact the retaining member 30. When the blade rotates, the blade carries the nonmagnetic mono-component toner 24 onto the retaining member 30. Additionally, some of the nonmagnetic mono-component toner 24 occasionally comes loose, and is directly carried onto the supply roller 26.

The supply roller 26 comes in contact with the developing roller 27 and rotates in the same direction as that of the developing roller so that the nonmagnetic mono-component toner 24 is carried on the developing roller 27. In this case, the excess toner scraped/dropped by the developing roller 27 on the supply roller 26 and the toner having charge amount sent to the retaining member 30 by the rotation of the supply 26 drop onto the bottom surface of the developer container 22 by gravity as they are, and are agitated by the carrying blade 31.

TABLE 1

| Measurement Item | With toner retaining member | Without toner retaining member | Guide plate/sheet member |
|---|---|---|---|
| Layer thickness | 0.5 mg/cm$^2$ or more | 0.1 mg/cm$^2$ or less | 0.5 mg/cm$^2$ or more |
| Torque | 2.5 kgf . cm | 2.5 kgf . cm | 2.5 kgf . cm |
| Toner spilling | 400 mm/s or more | 400 mm/s or more | 250 mm/s |
| Remarks | Present invention | Comparative example 2 | Comparative example 1 (conventional example) |

Table 1 shows results of an inspection regarding a layer thickness/charge amount of the nonmagnetic mono-component toner 24 on the developing roller 27, and a driving torque and toner spilling of the developing apparatus. In the inspection, an aluminum sleeve having a surface roughness of Rz 3.0 $\mu$m and a diameter of 18 mm was used as the developing roller 27, and a polyurethane foam member having a diameter of 14.2 mm and having a metal rod with a diameter of 6 mm in a center axis was used as the supply roller 26. The supply roller was allowed to bite and contact the developing roller 27 by 1.6 mm in a depth direction, a peripheral speed ratio of the developing roller 27 to the supply roller 26 was set to 1.0, and the developing apparatuses 6*a* to 6*d* were driven.

The layer thickness/charge amount of the toner was measured by a general suction type Faraday gauge.

Indicated as the toner spilling is a peripheral speed of the developing roller 27 of a point at which a spilling amount of the toner 24 to the outside of the developer container 22 from a nip portion between the developing roller 27 and the layer thickness regulating blade 28 is 0.1 mg or more.

Additionally, in the present embodiment, a gap between the developing roller 27 and the retaining member 30 in a horizontal direction is set to 4 mm. Furthermore, a film member 31*b* having a height of 0.5 mm is formed as a protrusion forming a toner reservoir 30*a* so as to project from a tip end of the retaining member 30 in a toner carrying direction.

Data of a constitution in which the retaining member 30 is not disposed and a constitution in which the retaining member is constituted of a guide plate and sheet member (polyurethane sheet having a thickness of 0.2 mm) as in the conventional example are shown as comparative data. During an experiment, in the layer thickness regulation of the toner, the layer thickness regulating blade constituted by mounting an urethane chip with a thickness of 1.0 mm on a leaf spring of SUS with a thickness of 0.1 mm was in contact with the developing roller with a pressing force of 70 N/m. Moreover, a general polyester type nonmagnetic mono-component toner (having a volume average particle diameter of 10.5 $\mu$m, and containing 4.5 wt % of phthalocyanine pigment and 2 wt % of wax) was used in the toner 24.

As seen from the result of Table 1, when the developing apparatus of the present invention is used, the toner 24 supplied to the developing roller 27 can securely be passed through the nip portion of the developing roller 27 and supply roller 26.

Therefore, a sufficient electric charge is applied to the toner 24, adhesion of the toner to the developing roller 27 can be enhanced, and as a result, toner spilling does not occur even during a high-speed driving of the developing roller 27 at a developing roller peripheral speed of 400 mm/s or more.

Furthermore, as compared with the conventional developing apparatus including the guide plate and sheet member, since the toner 24 is not accumulated in a space formed between the supply roller 26 and the developing roller 27, a driving torque of the developing roller 27 is reduced.

Additionally, when a diameter of the supply roller 26 is R(cm), and a length of the supply roller 26 in an axial direction is x(cm), and when a weight w(mg) of the toner 24 constantly retained on the retaining member 30 does not satisfy the relation $w>\pi Rx$, a solid follow-up property defect is caused in continuous output of a solid image.

To avoid this problem, an upper surface of the retaining member 30 is formed in a concave shape, or the film member 31*b* is formed so as to project from the tip end of the retaining member 30 in the toner carrying direction as described above.

As described above, according to the present embodiment, the tip end of the retaining member 30 in the toner carrying direction is disposed under the supply roller 26, and the gap from the developing roller 27 is formed. Therefore, the toner directed directly to the developing roller 27 from the retaining member 30 without being directed to the nip portion between the supply roller 26 and the developing roller 27 is dropped downwards from the gap and can securely be cut.

Therefore, the driving torque of the developing roller 27 can be reduced, only the sufficiently charged toner is supplied between the developing roller 27 and the layer thickness regulating blade 28, and the toner spilling in the layer thickness regulating blade 28 can be prevented.

Figure 3:
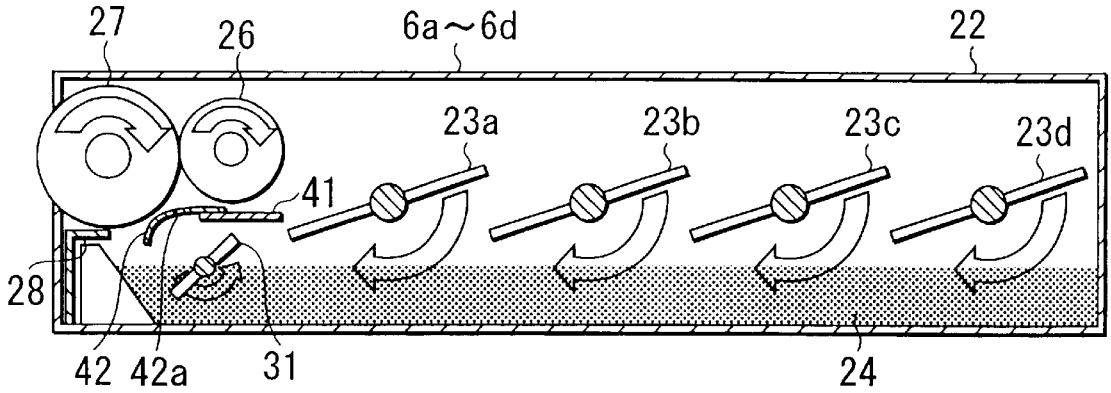
FIG. 3 is an inner constitution diagram showing a second embodiment of the developing apparatus.

FIG. 3 shows the developing apparatus according to a second embodiment of the present invention.

Additionally, the same portions as those described in the first embodiment are denoted with the same reference numerals and the description thereof is omitted.

A guide plate 41 is disposed under the supply roller 26. The guide plate 41 guides the nonmagnetic mono-component toner 24 carried by the rotation of the carrying blade 23*a* to the supply roller 26. The guide plate 41 is disposed apart from the bottom surface of the developer container 22 and the developing roller 27. An auxiliary guide 42 is disposed between the guide plate 41 and the developing roller 27.

The supply roller 26 comes in contact with the developing roller 27 and rotates in the same direction as that of the developing roller 27, so that the nonmagnetic mono-component toner 24 is carried on the developing roller 27. In this case, the excess toner scraped/dropped by the developing roller 27 onto the supply roller 26, and a part of the toner having a small charge amount sent from the guide plate 41 by the rotation of the supply roller 26 are accumulated on the auxiliary guide 42.

When the amount of the toner supplied to the developing roller 27 from the nip portion of the developing roller 27 and supply roller 26 is insufficient, the toner accumulated on the auxiliary guide 42 is carried by a carrying force of the developing roller 27 itself and supplied to the developing roller 27.

Figure 4:
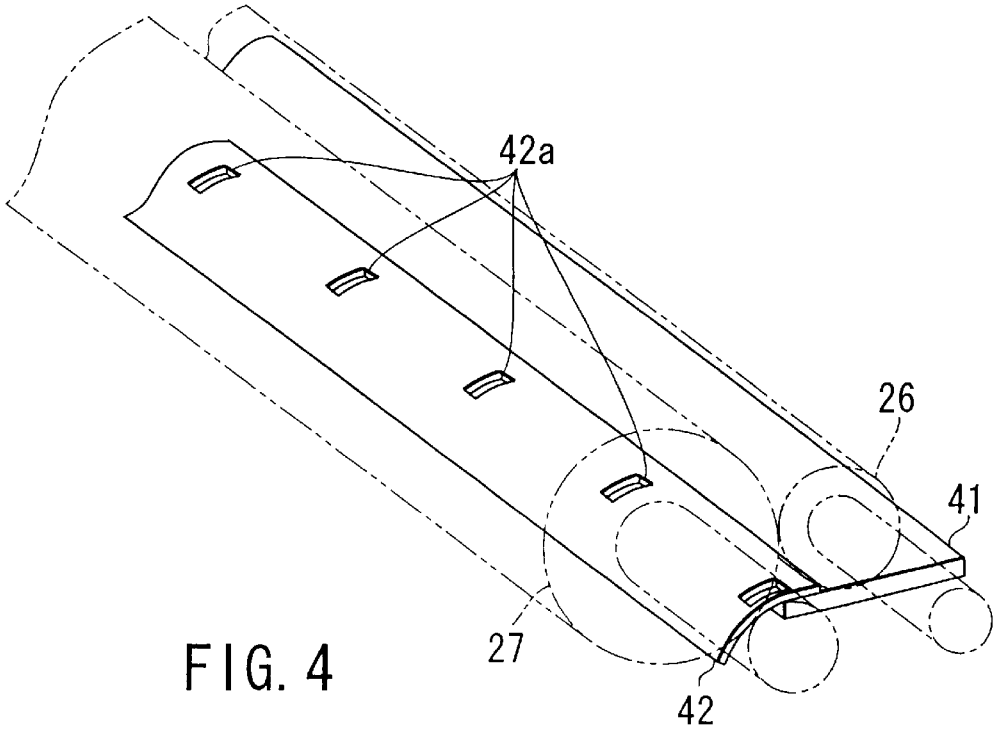
FIG. 4 is a perspective view showing a guide plate and sheet material disposed in the developing apparatus of FIG. 3.

Additionally, as shown in FIG. 4, a plurality of openings 42*a* are formed in the auxiliary guide 42, and a part of the toner 24 on the auxiliary guide 42 is dropped downwards via the openings 42*a*. Since the toner is dropped, and prevented from being excessively accumulated, the driving torque of the developing roller 27 can be prevented from increasing.

Furthermore, the surface of the auxiliary guide 42 is formed of a macromolecular material, and is in contact with the developing roller 27 with a predetermined pressing force. Therefore, while the layer thickness of the toner on the developing roller 27 is preliminarily regulated, the toner can be charged.

TABLE 2

| Measurement Item | Guide plate + auxiliary guide | Guide plate + sheet member | Guide plate only |
|---|---|---|---|
| Layer thickness [mg/cm$^2$] (initial/after 1 hr driving) | 0.57/0.52 | 0.60/0.55 | 0.50/0.43 |
| Charge amount [mC/g] (initial/after 1 hr driving) | 0.16/0.15 | 0.12/0.10 | 0.15/0.13 |

TABLE 2-continued

| Measurement Item | Guide plate + auxiliary guide | Guide plate + sheet member | Guide plate only |
|---|---|---|---|
| Torque (after 1 hr driving) | 2.5 kgf . cm | 3.5 kgf . cm | 2.5 kgf . cm |
| Toner spilling | 400 mm/s or more | 250 mm/s | 400 mm/s or more |
| Remarks | Present invention | Comparative example 1 (conventional example) | Comparative example 3 |

Table 2 shows the results of the inspection the layer thickness/charge amount of the toner on the developing roller 27 before and after driving, the driving torque of the developing apparatus, and a limit speed of toner spilling occurence (the peripheral speed of the developing roller.) In the inspection, an aluminum sleeve having a surface roughness of Rz 3.0 $\mu$m a diameter of 18 mm was used as the developing roller 27, and a polyurethane foam member having a diameter of 14.2 mm and having the metal rod with a diameter of 6 mm in the center axis was used as the supply roller 26. The supply roller 26 was allowed to bite and contact the developing roller 27 by 1.6 mm in depth direction, the peripheral speed ratio of the developing roller 27 to the supply roller 26 was set to 1.0, and developing apparatus was driven at a developing roller peripheral speed of 250 mm/s for one hour.

The layer thickness/charge amount of the toner on the developing roller 27 was measured by a general suction type Faraday gauge.

In the present embodiment, a general polyurethane rubber (thickness of 0.04 mm, rubber hardness of 70 degrees) formed as shown in FIG. 3 is used as the auxiliary guide 42, and was in contact with the developing roller 27.

Data of a constitution of the guide plate and simple sheet member (polyurethane having a thickness of 0.02 mm and a rubber hardness of 90 degrees and having no opening) described in the conventional example, and a constitution only of the guide plate are also shown as a comparative example.

During the experiment, in the layer thickness regulation of the toner, the layer thickness regulating blade 28 constituted by mounting the urethane chip with a thickness of 1.0 mm on the leaf spring of SUS with a thickness of 0.1 mm was in contact with the developing roller 27 with a pressing force of 70 N/m. The general polyester type nonmagnetic mono-component toner (having a volume average particle diameter of 10.5 $\mu$m, and containing 4.5 wt % of phthalocyanine pigment and 2 wt % of wax) was used in the toner 24. Moreover, each gap between the developing roller 27 and the guide plate 41 in the horizontal direction is 4 mm.

As shown in Table 2, with the use of the developing apparatus of the present invention, although a thick macromolecular member is used as the auxiliary guide 42, the torque after the driving is small as compared with a comparative example 1 (conventional example). This is because the toner 24 is not excessively accumulated in a space formed by the auxiliary guide 42, developing roller 27, and supply roller 26, and is allowed to escape to an inner bottom portion of the developer container 22 through the openings 42*a*.

Moreover, since the thick macromolecular member as the auxiliary guide 42 is in contact with the developing roller 27, the charge amount of the toner 24 can be set to be large.

Therefore, the toner spilling does not occur even at the developing roller peripheral speed of 400 mm/s.

Furthermore, with the constitution only of the guide plate as in comparative example 2, the urethane foam of the supply roller 26 is clogged with toner 24, and the layer thickness largely changes. However, in the developing apparatus of the present invention, since the toner on the auxiliary guide 42 is used to form the toner layer on the developing roller 27, the carrying amount does not largely change before and after the driving.

Moreover, the auxiliary guide 42 is not limited to the single material of the macromolecular film, and a member constituted by bonding/mounting a macromolecular film or chip onto a metal leaf spring member may be used without any problem.

Furthermore, in the second embodiment, the toner is dropped via the openings 42*a* formed in the auxiliary guide 42, but this is not limited. A length of the auxiliary guide 42 along a direction crossing at right angles to the toner guide direction may be set to be less than the length of the guide plate 41 so that the toner drops from opposite ends of the auxiliary guide 42.

Figure 5:
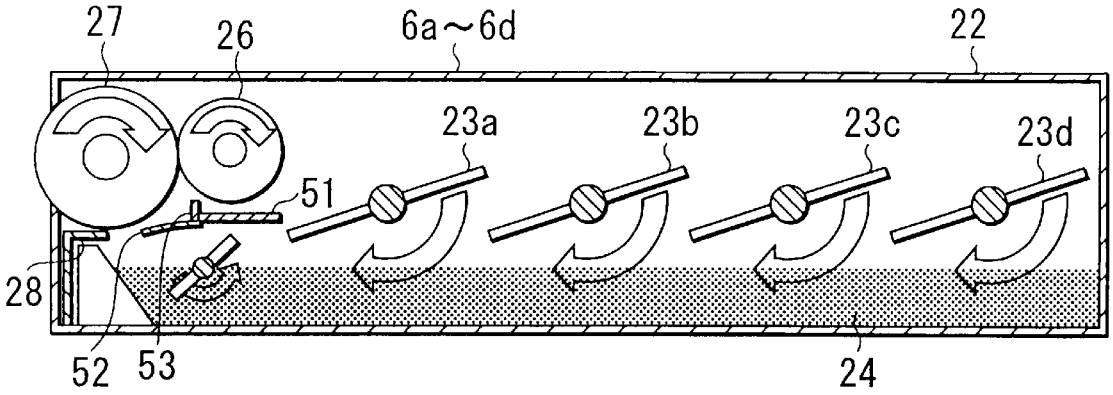
FIG. 5 is an inner constitution diagram showing a third embodiment of the developing apparatus.

FIG. 5 shows the developing apparatus according to a third embodiment of the present invention.

Additionally, the same portions as those described in the first embodiment are denoted with the same reference numerals and the description thereof is omitted.

Figure 6:
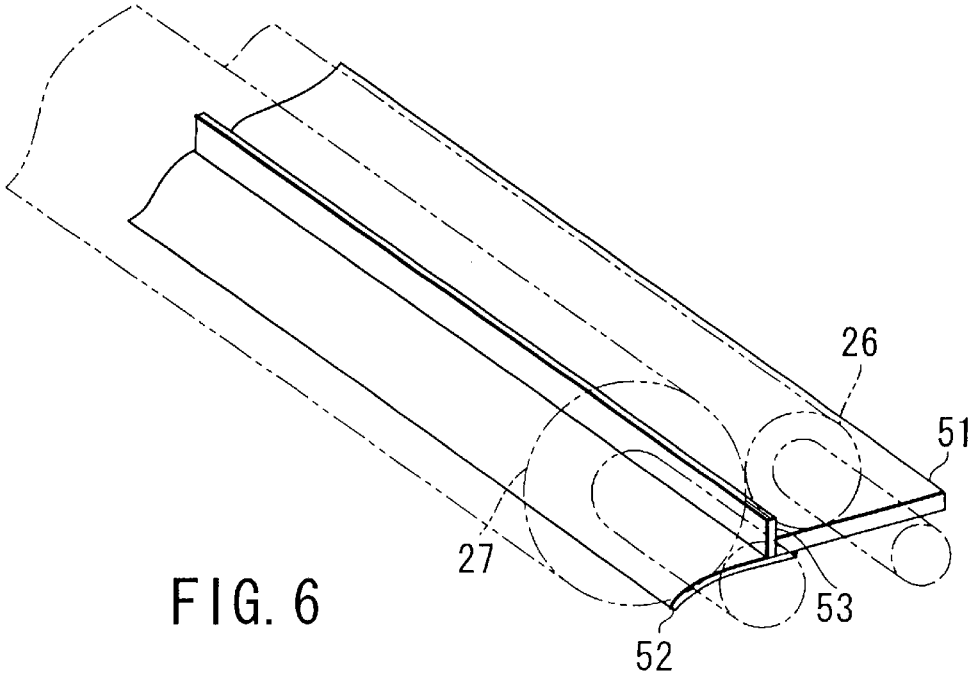
FIG. 6 is a perspective view showing the guide plate and sheet material disposed in the developing apparatus of FIG. 5.

In the third embodiment, as shown also in FIG. 6, a guide plate 51 is disposed under the supply roller 26. The guide plate 51 guides the toner 24 carried by the rotation of the carrying blade 23*a* to the supply roller 26. The guide plate 51 is disposed apart from the bottom surface of the developer container 22 and the developing roller 27.

An auxiliary guide 52 is disposed between the guide plate 51 and the developing roller 27. Moreover, a regulating member 53 for regulating a flow of the toner 24 to the auxiliary guide 52 from the guide plate 51 is disposed between the guide plate 51 and the auxiliary guide 52.

The supply roller 26 comes in contact with the developing roller 27 and rotates in the same direction as that of the developing roller, so that the nonmagnetic mono-component toner 24 is carried on the developing roller 27. In this case, the toner 24 having a small charge amount is directly fed onto the auxiliary guide 52 from the guide plate 51 by the rotation of the supply roller 26, but this flow of toner is regulated by the regulating member 53. Thereby, all the toner supplied by the supply roller 26 is fed to the nip portion between the supply roller 26 and the developing roller 27.

Therefore, since the toner sufficiently charged and dropped in the nip portion between the supply roller 26 and the developing roller 27 is accumulated on the auxiliary guide 52, the charge amount is large, and the toner spilling phenomenon can be prevented.

When the amount of the toner supplied to the developing roller 27 from the nip portion with the supply roller 26 is insufficient, the toner accumulated on the auxiliary guide 52 is supplied to the developing roller 27 by the carrying force of the developing roller 27 itself.

TABLE 3

| Measurement item | With toner flow regulating member | Without toner flow regulating member |
|---|---|---|
| Layer thickness | 0.5 mg/cm$^2$ or more | 0.5 mg/cm$^2$ or more |
| Charge amount | 0.15 mC/g | 0.12 mC/g |
| Toner spilling limit | 400 mm/s or more | 250 mm/s |
| Remarks | Present invention | Comparative example 1 |

Table 3 shows the results of the inspection regarding the layer thickness/charge amount of the toner on the developing roller 27, and the limit speed of toner spilling occurrence (the peripheral speed of the developing roller). In the inspection, the aluminum sleeve having a surface roughness of Rz 3.0 $\mu$m and a diameter of 18 mm was used as the developing roller 27, and the polyurethane foam member having a diameter of 14.2 mm and having a metal rod with a diameter of 6 mm in the center axis was used as the supply roller 26. The supply roller 26 was allowed to bite and contact the developing roller 27 by 1.6 mm in the depth direction, the peripheral speed ratio of the developing roller 27 to the supply roller 26 was set to 1.0, and the developing apparatus was driven at a developing roller peripheral speed of 250 mm/s.

The layer thickness/charge amount of the toner on the developing roller 27 was measured by the general suction type Faraday gauge.

In the present embodiment, general polyurethane rubber (thickness of 0.02 mm, rubber hardness of 90 degrees) is used as the auxiliary guide 52 to contact the developing roller 27. Moreover, the toner flow regulating member 53 having a projecting height of 1.5 mm (polyurethane, thickness of 0.02 mm, hardness of 90 degrees) is formed on auxiliary guide 52.

During toner layer regulation, the layer thickness regulating blade 28 constituted by mounting the urethane chip with a thickness of 1.0 mm on the leaf spring of SUS with a thickness of 0.1 mm was in contact with the developing roller 27 with a pressing force of 70 N/m. A general polyester type nonmagnetic mono-component toner (having a volume average particle diameter of 10.5 $\mu$m, and containing 4.5 wt % of phthalocyanine pigment and 2 wt % of wax) was used in the toner 24.

A constitution without the toner flow regulating member 53 is also shown as the comparative example. When the toner flow regulating member 53 is disposed, the toner 24 having a small charge amount is not fed directly to the developing roller 27 from the guide plate 51 via the auxiliary guide 52, the charge amount of the toner 24 increases, and the toner spilling limit peripheral speed can be set to 400 mm/s or more.

Additionally, a similar effect can be obtained even from a constitution in which the toner flow regulating member 53 is integrally formed on the guide plate 51 itself, in a projecting manner.

Moreover, the toner flow regulating member 53 may be disposed on the upper surface of the auxiliary guide 52 without any problem.

As described above in the present invention, according to the first embodiment, the retaining member 30 which can once retain the toner 24 carried via the carrying blade 23*a* is disposed apart from the developing roller 27 under the supply roller 26. Therefore, the toner 24 supplied to the developing roller 27 can securely be passed through the nip portion of the developing roller 27 and supply roller 26, and the toner spilling or the torque rise does not occur.

In the second embodiment, since the openings 42*a* are formed in the auxiliary guide 42 disposed between the guide plate 41 and the developing roller 27, a part of the toner on the auxiliary guide 42 can be dropped downwards via the openings 42*a* Therefore, the toner is not excessively accumulated on the auxiliary guide 42, and the driving torque of the developing roller 27 can be reduced.

Moreover, since the auxiliary guide 42 abuts on the developing roller 27, and the surface of the auxiliary guide is formed of the macromolecular material, the toner on the developing roller 27 is preliminarily charged and the layer thickness of the toner can be regulated. The toner spilling in the layer thickness regulating blade 28 can securely be prevented from occurring.

In the third embodiment, the auxiliary guide 52 is disposed between the guide plate 51 and the developing roller 27, the regulating member 53 is disposed between the guide plate 51 and the auxiliary guide 52, and the regulating member 53 regulates the flow of the toner to the auxiliary guide 52 from the guide plate 51. Therefore, the toner 24 accumulated on the regulating member 53 has been once sufficiently charged in the nip portion of the supply roller 26 and developing roller 27, the charge amount is large, and the toner spilling phenomenon can securely be prevented.

Additional advantages and modifications will readily occur to those skilled in the art. Therefore, the invention in its broader aspects is not limited to the specific details and representative embodiments shown and described herein. Accordingly various modifications may be made without departing from the spirit or scope of the general inventive concept as defined by the appended claims and their equivalents.

What is claimed is:

1. A developing apparatus comprising:

a developing roller which is brought in contact with an image bearer, and rotates upwards from below in a contact portion to supply a developer to said image bearer;

a supply roller which is brought in contact with the developing roller, and rotates in the same direction as the direction of the developing roller to supply the developer to said developing roller;

a carrying device for carrying the developer to the supply roller;

a retaining member which is positioned below said supply roller and disposed apart from said developing roller, and which retains the developer carried by said carrying device and allows the retained developer to be supplied to said developing roller by said supply roller; and a layer thickness regulating member for regulating a layer thickness of the developer supplied onto said developing roller.

2. The developing apparatus according to claim 1, wherein a tip end of said retaining member in a developer supply direction is positioned below said supply roller.

3. The developing apparatus according to claim 1, wherein assuming that a diameter of said supply roller is R(cm), and a length of the supply roller in an axial direction is x(cm), a weight w(mg) of the developer retained by said retaining member satisfies the relation of $w>\pi Rx$.

4. The developing apparatus according to claim 3, wherein an upper surface of said retaining member is formed in a concave shape.

5. The developing apparatus according to claim 3, wherein said retaining member has.a protrusion on a tip end of the retaining member in a supply direction of the developer supplied by rotation of said supply roller.

6. A developing apparatus comprising:

a developing roller which is brought in contact with an image bearer, and rotates upwards from below in a contact portion to supply a developer to said image bearer;

a supply roller which is brought in contact with the developing roller, and rotates in the same direction as the direction of the developing roller to supply the developer to said developing roller;

a carrying device for carrying the developer to the supply roller;

a guide member which is positioned below said supply roller and disposed apart from said developing roller, and which guides the developer carried by said carrying device to said supply roller;

an auxiliary guide which is disposed between the guide member and said developing roller, and which guides the developer fed from said guide member by rotation of said supply roller to said developing roller; and a layer thickness regulating member for regulating a layer thickness of the developer supplied onto said developing roller, wherein said auxiliary guide has a structure for dropping a part of the developer downwards during guiding of said developer, a tip end of the auxiliary guide in a guide direction of the developer is allowed to abut on said developing roller, the abutment portion is constituted of a macromolecular material, the developer on said developing roller is preliminarily charged, and a layer thickness of the developer is regulated.

7. The developing apparatus according to claim 6, wherein a length of said auxiliary guide in a direction crossing at right angles to the guide direction of the developer is set to be less than the length of said guide member.

8. The developing apparatus according to claim 6, wherein said auxiliary guide has an opening for dropping a part of the developer downwards.

9. A developing apparatus comprising:

a developing roller which is brought in contact with an image bearer, and rotates upwards from below in a contact portion to supply a developer to said image bearer;

a supply roller which is brought in contact with the developing roller, and rotates in the same direction as the direction of the developing roller to supply the developer to said developing roller;

a carrying device for carrying the developer to the supply roller;

a guide member which is positioned below said supply roller and disposed apart from said developing roller, and which guides the developer carried by said carrying device to said supply roller;

an auxiliary guide which is disposed between the guide member and said developing roller, and which receives the developer falling from the contact portion between said developing roller and said supply roller and guides the developer to said developing roller;

a movement regulating member for regulating movement of the developer to said auxiliary guide from said guide member; and a layer thickness regulating member for regulating a layer thickness of the developer supplied onto said developing roller.

* * * * *